United States Patent [19]

Glöckler et al.

[11] Patent Number: 4,644,922

[45] Date of Patent: Feb. 24, 1987

[54] METHOD AND APPARATUS FOR CONTROLLING THE OVERRUN MODE OF OPERATION OF AN INTERNAL COMBUSTION ENGINE

[75] Inventors: Otto Glöckler, Renningen; Dieter Günther, Murr; Ulrich Steinbrenner, Stuttgart, all of Fed. Rep. of Germany

[73] Assignee: Robert Bosch GmbH, Stuttgart, Fed. Rep. of Germany

[21] Appl. No.: 790,041

[22] Filed: Oct. 22, 1985

Related U.S. Application Data

[63] Continuation-in-part of Ser. No. 625,857, Jun. 28, 1984, abandoned.

[30] Foreign Application Priority Data

Jul. 1, 1983 [DE] Fed. Rep. of Germany ..... 3323723

[51] Int. Cl.[4] ..... F02B 3/00

[52] U.S. Cl. ..... 123/493; 123/491; 123/492; 123/179 G; 123/179 L

[58] Field of Search ..... 123/493, 491, 179 G, 123/179 L, 492, 326, 438, 488

[56] References Cited

U.S. PATENT DOCUMENTS

| | | | |
|---|---|---|---|
| 4,094,274 | 6/1978 | Harada et al. | 123/493 |
| 4,180,025 | 12/1979 | Steinbrenner et al. | 123/493 |
| 4,204,483 | 5/1980 | Harada et al. | 123/493 |
| 4,214,306 | 7/1980 | Kobayashi | 123/493 |
| 4,221,191 | 9/1980 | Asano et al. | 123/493 |
| 4,237,830 | 12/1980 | Stivander | 123/493 |
| 4,387,687 | 6/1983 | Hoppol | 123/493 |
| 4,440,127 | 4/1984 | Virgilio | 123/493 |
| 4,450,816 | 5/1984 | Takimoto et al. | 123/493 |
| 4,466,413 | 8/1984 | Oonishi et al. | 123/493 |

*Primary Examiner*—Raymond A. Nelli

*Attorney, Agent, or Firm*—Walter Ottesen

[57] ABSTRACT

The invention is directed to a method and an apparatus for controlling the overrun mode of operation of an internal combustion engine, wherein instantaneous values of the relevant negative speed change of the internal combustion engine are sensed and evaluated to control the overrun mode. In this arrangement, a higher resume speed which is selected on commencement of the overrun mode and reduced to a lower speed limit after a predetermined time function, can be shifted additionally in dependence on the negative speed change. Further, to keep an internal combustion engine from stalling, the actual value of the negative speed change can be compared with a predetermined desired value; if it exceeds that value, the decision for a resume of fuel delivery can be made without delay.

14 Claims, 11 Drawing Figures

METHOD AND APPARATUS FOR CONTROLLING THE OVERRUN MODE OF OPERATION OF AN INTERNAL COMBUSTION ENGINE

RELATED APPLICATION

This is a continuation-in-part of the application Ser. No. 625,857 filed June 28, 1984, now abandoned and entitled "Method and Apparatus for Controlling the Overrun Mode of Operation of an Internal Combustion Engine".

BACKGROUND OF THE INVENTION

In the operation of an internal combustion engine, it is known to interrupt the supply of fuel when the throttle valve is closed at higher and high engine speeds, that is, when the internal combustion engine is in the overrun mode of operation. However, an overrun condition exists also if the engine speed of an internal combustion engine is higher than corresponds to the throttle position in a spark-ignition engine or to the quantity of fuel injected in a Diesel engine; if the internal combustion engine is in overrun operation, no output is desired. Therefore, fuel delivery to the internal combustion engine through carburetors, injection systems or the like is reduced or interrupted entirely.

In this manner, substantial fuel savings can be realized; on the other hand, the overrun mode is not without problems since the interruption of fuel supply causes the internal combustion engine to cool down to a certain degree, followed by higher pollutant emissions for a period of time following termination of the overrun mode, and it may also adversely affect the driving comfort when the engine switches from the overrun to the normal mode. Another problem is that the engine speed behavior always has to be monitored closely, that is, the engine is not permitted to stall, not even if the supply of fuel is interrupted during overrunning while the engine is still cold. Thus, for example, a critical load may be encountered when, with the overrun cutoff mode enabled, the vehicle drives downhill with the engine still cold, that is, when the fuel supply is interrupted while the throttle valve is closed, and when the clutch is suddenly disengaged. As a result, the internal combustion engine is no longer driven by the rotational movement of the wheels through the transmission. In such a case, there is the danger of the engine speed dropping so abruptly that the engine stalls before countermeasures can be taken.

Therefore, in a system providing for the interruption of the fuel supply with the engine overrunning, as disclosed in copending U.S. patent application entitled "Method for Operating an Apparatus for a Fuel Control System of an Internal Combustion Engine during Overrunning", having Ser. No. 410,669 and filed on Aug. 23, 1982 it is known to compare the actual engine speed with a predetermined, time-dependent characteristic of a resume speed and to interrupt the supply of fuel to the internal combustion engine only if the actual engine speed is above the characteristic of the resume speed. This makes it possible to sense the relevant operating state more accurately; the overrun cutoff mode is disabled if the engine speed drops below the desired resume speed characteristic, and jerks caused by fuel-delivery resumptions can be avoided, thus adding to the driving comfort. Nevertheless, the known system for shutting off the fuel supply in the overrun mode of operation does not lend itself to universal use, nor is its response to all possible operating conditions sufficiently flexible.

SUMMARY OF THE INVENTION

By contrast, the method and the arrangement of the invention afford the advantage of permitting a substantially more comprehensive response to practically all possible operating conditions of an internal combustion engine during overrunning so that the measures for fuel-supply shutoff can be extended to cover a wider operating range without adversely affecting the vehicle behavior and the stability of the engine. The invention permits significant fuel savings in city traffic, in particular on vehicles equipped with automatic transmissions and vehicles having long total transmission ratios. Since it adjusts to the overrun cutoff mode adaptively, the invention also ensures continued operation of the internal combustion engine even in cases where, as indicated above, the engine speed should drop extremely sharply. The particularly flexible and adaptive response to the overrun cutoff mode, as provided by the invention, is not only due to the fact that it is monitored, whether the actual engine speed has dropped below predetermined threshold characteristics of the resume speed, followed by a suitable reaction, but also that the engine speed behavior is sensed dynamically and evaluated.

In other words, the relationship between the interception functions, keeping the engine from stalling, and the variability of engine speed values determining the resume speed characteristic on the basis of, and in dependence on, negative actual speed changes makes it possible to trigger reactions during and for the resumption of fuel delivery. By these means, the operating range of the overrun mode in which fuel supply to the internal combustion engine is interrupted, is not only substantially extended, but it is also possible to set the primarily statically determined engine speed points (resume speed) at minimum possible values without the risk of the engine stalling and/or the vehicle jerking when the accelerator is suddenly depressed.

In an embodiment of the invention, this is advantageously furthered by using the desired (computed) value, a fuel increment or a fuel decrement, each related to the negative speed change information as made available by the apparatus of the invention, as additional inputs for the control of the fuel quantity. This negative speed change is preferably treated as a function of the actual speed of the internal combustion engine. In other words, the influence on specific measures or interception functions will vary depending on the speed range in which the major or minor negative speed change has been detected. Thus, during dynamic speed drops as they occur, for example, when the clutch is disengaged while the engine is overrunning, the engine can always be safely intercepted at a predetermined speed lying above the static resume speed.

Further, the invention reliably prevents the occurrence of idle hunting which might result from an excessive idle speed during warm-up or at idling following a temporary stalling of the engine.

The method and apparatus of the invention allow the combination of a static action in which the response takes place when the actual engine speed has dropped below a resume speed curve with a dynamic action in which the decision for resumption of fuel delivery is always made on detection of a predetermined negative speed drop, the latter case further depending on the numerical speed value at which the negative speed change has occurred.

The invention provides criteria for the metering of fuel to an internal combustion engine during the overrun mode of operation with the aid of the first differential of the engine speed with respect to time, dn/dt (dynamic course). In this way, sharp drops in the rotational speed of the engine which could cause the engine to stall are recognized so that appropriate countermeasures can be taken.

BRIEF DESCRIPTION OF THE DRAWING

The invention will now be explained with reference to the drawing wherein.

DESCRIPTION OF THE PREFERRED EMBODIMENTS OF THE INVENTION

The basic idea underlying the invention is to add a dynamic sensing of the actual speeds of the internal combustion engine to existing control possibilities for the overrun mode of operation and thus permit a direct response to tendencies of the internal combustion engine to change its speed, either by immediate remedial action or by shifts of reference characteristics governing the control functions of fuel-supply shutoff in overrun operation (overrun cutoff) or resumption of fuel supply (RE).

In addition, an embodiment of the invention permits the decision for excess or reduced fuel on resumption of fuel delivery to be made with consideration of the negative speed change sensed, so that overall there results a particularly flexible and powerful system for controlling the overrun cutoff mode of operation which is universally applicable to any type of vehicle.

For a better understanding of the environment of the invention, a fuel-injection system for a spark-ignition engine (Otto engine) will be briefly explained with reference to the schematic of FIG. 1. It is to be understood that the invention is applicable to any internal combustion engine and any fuel-metering system, in particular to internal combustion engines in which the required amounts of fuel are delivered via carburetors or other systems.

Figure 1:
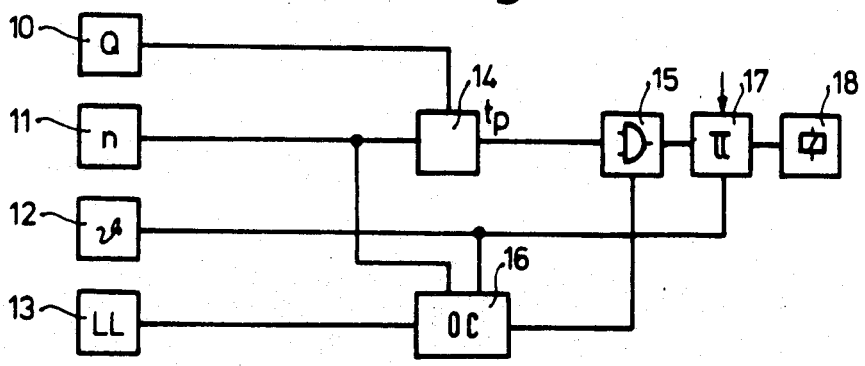
FIG. 1 is a simplified schematic block diagram depicting an injection system for a spark-ignition engine as the preferred field of application of the invention.

The basic elements of the injection system shown in FIG. 1 are a sensor 10 sensing the volume of air passing through or inducted by the internal combustion engine in the intake pipe, a sensor 11 sensing the speed n of the internal combustion engine, a temperature sensor 12 and a sensor 13 for the idle-speed condition. Sensor 13 may be configured as a throttle-valve position sensor and includes a contact producing an electrical signal $\alpha_{TV}=0$ or $\alpha_{TV}>0$ with the accelerator pedal released and the throttle valve closed.

Reference numeral 14 denotes a timing element that generates basic injection pulses of a duration $t_p$ in dependence on the air-flow rate and the engine speed. Connected to the output of timing element 14 is a logic element 15 processing the output signals from an overrun cutoff stage 16 which in its basic concept may be configured according to the flow diagram of FIG. 11.

Overrun cutoff stage 16 in turn processes the output signals of speed sensor 11, throttle-position sensor 13 for the idling condition, and temperature sensor 12. Connected to the output of logic element 15 is a multiplier 17 correcting the injection signals at least in dependence on temperature, its output activating injection valves represented at 18 via suitable final stages. This fuel-injection system whose structure and function are known per se shows how appropriate the provision of the system for controlling the overrun mode of operation as disclosed in the invention is.

Figure 2:
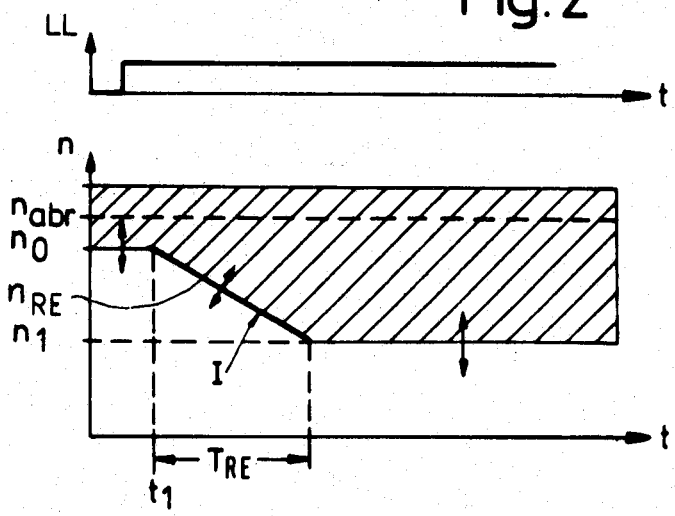
FIG. 2 is a graphical representation of a resume speed characteristic.

The speed versus time diagram of FIG. 2 shows the course of a (predetermined) resume speed characteristic, that is, the course of $n_{RE}$ plotted against time t. Characteristic I separates an upper hatched area in which the further supply of fuel to the internal combustion engine is interrupted because an overrun condition has been detected from a lower area in which, applied to the present embodiment, injection pulses are generated resulting in the delivery of suitable amounts of fuel to the internal combustion engine.

Special parameters in the diagram of FIG. 2 are as follows: a (static) lower resume speed limit at $n_1$; a (dynamic) resume speed limit at $n_0$; and, a time function between these two limits shown as a straight line with a negative gradient which, during the time period $T_{RE}$ (the regulation time of the dynamic resume speed), is a time function $n_{RE}(t)$.

By introducing the dynamic speed sensing function, these preselectable parameters $n_0$, $n_1$ and $n_{RE}(t)$ may experience shifts indicated by the double arrows in the diagram; this is a first possibility to provide for inclusion of the negative differential of the relevant actual speed of the internal combustion engine.

To explain a practical application in this context, it is to be assumed that in the cutoff range, that is, with the engine overrunning at an actual speed still above a predetermined speed $n_{abr}$ (which will be explained later), there occurs an extremely sharp drop in engine speed, for example, due to the vehicle operator having disengaged the clutch during engine overrunning with the fuel supply shut off. In this case, the continuously sensed information $-dn/dt=f(n_{mot})$may provide for an initial rise in the dynamic resume speed $n_0$. In the general case, for example, the entire resume speed characteristic I is raised to a higher level so that the internal combustion engine can be safely intercepted prior to stalling. Thus, continued safe running of the engine is ensured. It is to be understood that this possibility of application represents merely an example of a flexible reaction in the overrun mode of operation by evaluating dynamic speed conditions. Another possibility is to switch over to resume fuel delivery immediately on detection of a value exceeding a predetermined negative speed differential of the actual speed, with or without consideration of characteristics $n_{RE}=f(t)$ shifting, where applicable, in a complementary manner.

Accordingly, for an internal combustion engine in the overrun mode of operation, there exists a resume speed threshold which changes with time and has an upper resume speed and a lower resume speed. This threshold can be moved to higher or lower values of speed in dependence upon negative values of the first differential with respect to time of the rotational speed $(-dn/dt)$. Thus, the threshold can be controlled by values of $(-dn/dt)$.

The basic operation and the reactions for the overrun mode of operation as disclosed in the invention and further explained in the following with reference to the three embodiments of FIGS. 3, 4 and 5 relate to the static application in which the inclusion of the negative speed differential of the instantaneous speed is initially disregarded, such that with the idle speed contact LL closed (upper diagram of FIG. 2) and the actual speed n dropping below a predetermined speed $n_{abr}$, which may, for example, be set at $n_0+100\ min^{-1}$, the speed regulation of the threshold characteristic starts from the raised parameter of the dynamic resume speed $n_0$. The speed regulation from $n_0$ to the static resume threshold $n_1$ takes place within time $T_{RE}$ and, of course, also when, with the idle speed contact closed, the engine speed has already dropped below the threshold speed $n_0$, that is, at $n<n_0$.

Figure 3:
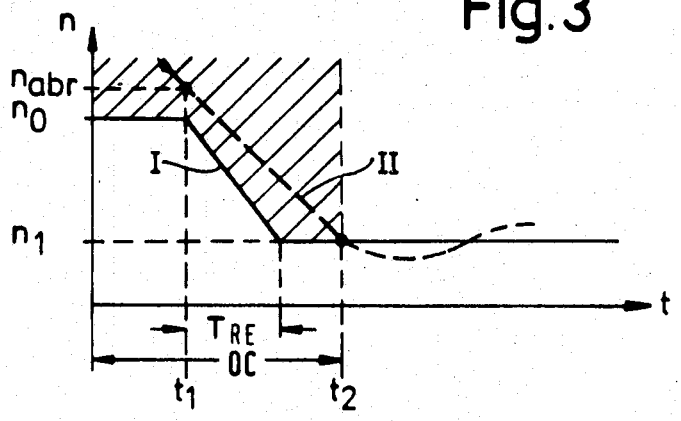
FIGS. 3, 4 and 5 are graphical representations of various operating states for the overrun mode of operation and depict the instantaneous engine speed in the resume speed characteristic of FIG. 2.
Figure 4:
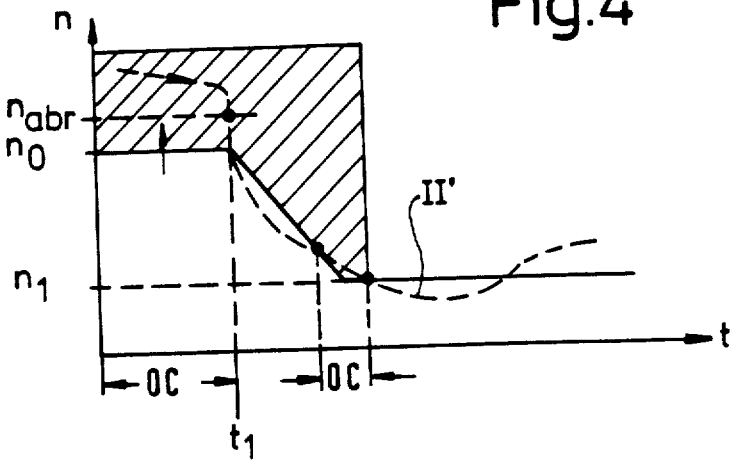
Figure 5:
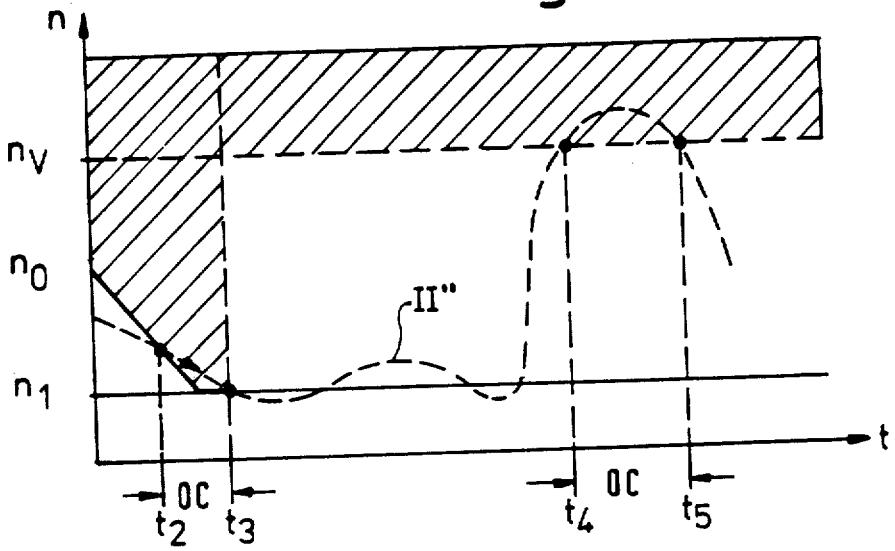

In the speed versus time diagrams of FIGS. 3, 4 and 5 illustrating the resume speed characteristic, the relevant instantaneous or actual speeds n are shown in broken lines as characteristics II, II' and II'', respectively.

FIG. 3 shows an overrun mode of operation with the speed dropping slowly; as soon as the actual speed reflected by characteristic II reaches the speed $n_{abr}$ at time $t_1$, the speed regulation will commence for the course of the resume speed $n_{RE}=f(t)$ whose gradient may be preselected such that, with the actual speed dropping slowly, the two characteristics I and II extend almost parallel in this range; in this case, therefore, the actual speed characteristic II intersects the resume speed characteristic relatively late at time $t_2$, and an overrun cutoff condition will be present for the whole period of time until $t_2$ since the actual speed is always above the resume speed. If the speed drops as slowly as shown in FIG. 2, there occurs only a relatively minor drop of the effective speed below the (static) resume speed threshold $n_1$ since the delivery of fuel will be resumed from time $t_2$. With the characteristic pursuing a course as shown in FIG. 3, wherein the negative speed change is relatively small, the static sensing method may be retained, thus obviating the need for a higher-order intervention via the information $-dn/dt$. The resumption of fuel delivery after time $t_2$ causes the speed to rise again in a soft curve and the engine to run at idle. In order to prevent idle hunting, an inhibit threshold may be provided which will be explained later with reference to FIG. 5.

The characteristic II' of FIG. 4 illustrates the possible case wherein the vehicle operator disengages the clutch abruptly while the engine is overrunning, so that an almost vertical drop of the actual speed occurs practically immediately before $t_1$. Several complementary measures are possible in this case; sensing these extremely abrupt negative speed changes may result in the prompt selection of the fuel-supply resume function RE, depending on the numerical value of the actual speed at this particular moment, which case is not shown in the diagram of FIG. 4, and/or in the threshold of the dynamic resume speed $n_0$ being raised, accompanied, where applicable, by a simultaneous rise in the static resume threshold $n_1$ and the delivery of excess fuel which will be explained in more detail in the following. As a result of such a highly flexible system response to the abrupt drop in engine speed, the actual speed characteristic II' may temporarily reenter the cutoff area OC during which period the fuel supply is again interrupted.

In the diagram of FIG. 5, an overrun condition is present at time $t=0$; the actual speed drops below the dynamic resume speed $n_0$, followed by a rise in speed which may be caused, for instance, by re-engagement of the clutch at a relatively high vehicle velocity, the clutch having been previously disengaged while the engine was overrunning, and the driven wheels accelerating the engine from idling to higher speeds. In this case, overrun cutoff phases occur between $t_2$ and $t_3$ and again between $t_4$ and $t_5$; for the latter period, fuel delivery is interrupted only if the increase in engine speed is such that a predetermined inhibit threshold $n_V$ which may be set at $n_1+1000 \ldots 1200\ min^{-1}$,for example, is exceeded. Inhibiting an overrun cutoff function OC with the idle contact closed and the engine speed rising again up to the inhibit threshold $n_V$ is an effective countermeasure against possible idle hunting.

Figure 6:
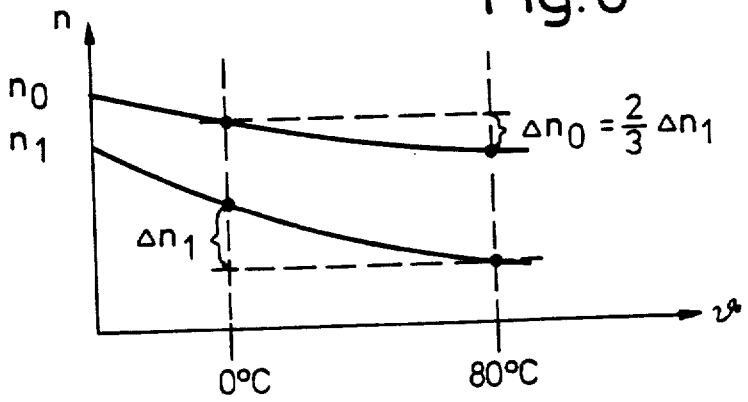
FIG. 6 is a graphical representation of time-independent reference quantities of the resume speed characteristic plotted as a function of temperature.

In addition to showing the dependence of thresholds $n_1$ and $n_0$ and, where applicable, of the duration of the speed regulation time $T_{RE}$ and the rise on the negative speed change, FIG. 6 also illustrates the dependence of these thresholds on temperature. The threshold characteristics of $n_0$ and $n_1$ as indicated in FIG. 6 are realizable threshold characteristics plotted against the temperature; they depend primarily on the warm-up functions of the relevant internal combustion engine and introduce a dual dependence of the characteristic $n_{RE}$ and thus of the possible overrun cutoff functions OC on the temperature and on the negative speed change. The values for $n_1$, $n_0$ and $T_{WE}$ are suitably defined at $\theta=80°$ C.

Figure 7:
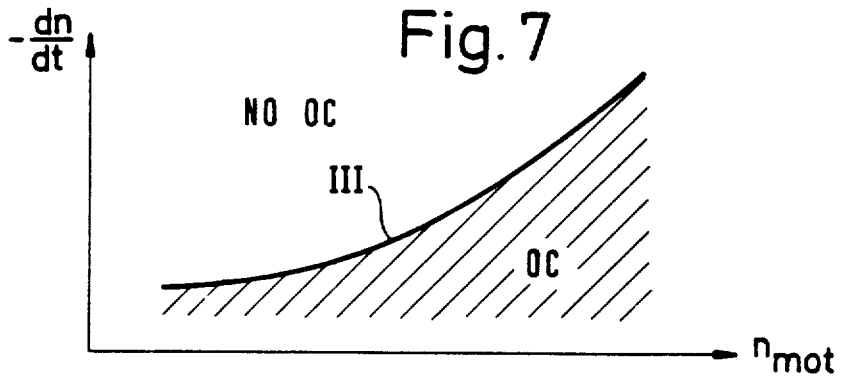
FIG. 7 is a graphical representation of the negative speed change of the instantaneous or actual engine speed plotted against the speed of the internal combustion engine, subdivided into the areas of overrun cutoff mode and no overrun cutoff mode.
Figure 8:
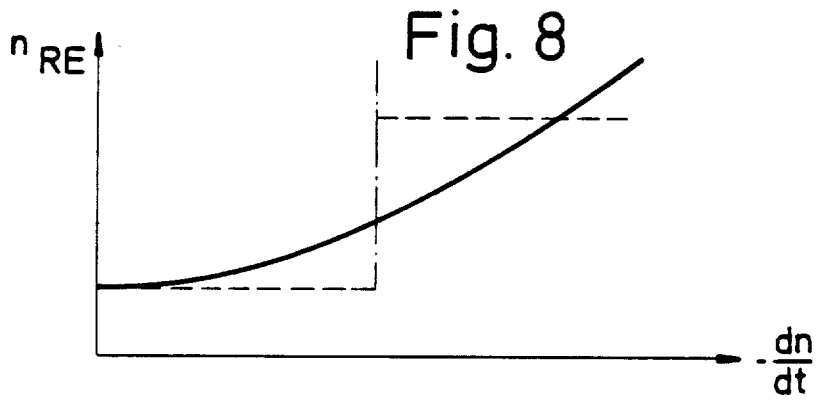
FIG. 8 is a graphical representation of the resume speed as a function of the negative speed change of the actual engine speed.

The characteristics of FIGS. 7 and 8 illustrate the influence of the negative speed change on the resume speed or engine speed characteristic, as well as the dependence of the negative speed change on the instantaneous speed of the internal combustion engine.

Characteristic III of FIG. 7 defines an upper area in which overrun cutoff functions (OC), that is, the interruption of fuel supply, are not permitted, either because the actual engine speed is too low in this area so that a sharp drop might cause the engine to stall, or because the negative speed drop is so significant, in spite of the presence of higher speeds, that fuel delivery must not be interrupted. In the area below characteristic III which may also be determined empirically in dependence on the relevant engine data, the interruption of fuel supply is permitted, either because the engine speed is high enough or because the negative speed change remains small.

The characteristic of FIG. 8 shows that the resume speed is increased as the negative speed change $-dn/dt$ increases. In the most simple case, the dynamic resume speed $n_0$ is increased or the entire characteristic I is raised continuously or in steps, depending on the prevailing effective negative speed change.

Figure 9:
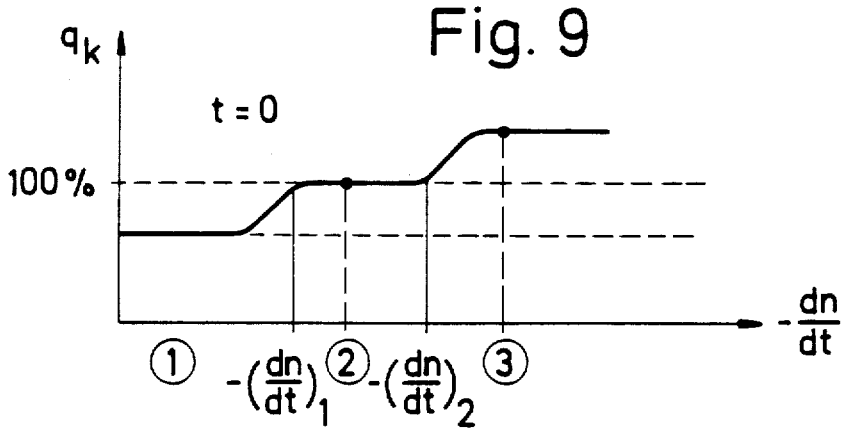
FIG. 9 is a graphical representation of an embodiment showing the dependence of the amount of fuel supplied on the resumption of fuel delivery on the negative speed change of the actual engine speed.

In another advantageous embodiment of the invention, simultaneously with the information $-dn/dt$, the amount of fuel is controlled on resumption of fuel delivery (RE) by the desired value, by an increment (which in a fuel-injection system is accomplished by increasing the normal pulse or adding extra injections), or by a decrement. The characteristic of FIG. 9 shows that below a first negative speed change threshold $-(dn/dt)_1$, a fuel decrement can be used in area (1); in area (2) of the diagram of FIG. 9, that is, between the two values $-(dn/dt)_1$ and $-(dn/dt)_2$, the normal or desired quantity becomes applicable; and at very significant negative speed changes, that is, on sharp speed drops, substantial fuel increments result, area (3), all these quantities being delivered at time $t=0$ which is the moment in which fuel delivery is resumed.

Figure 10:
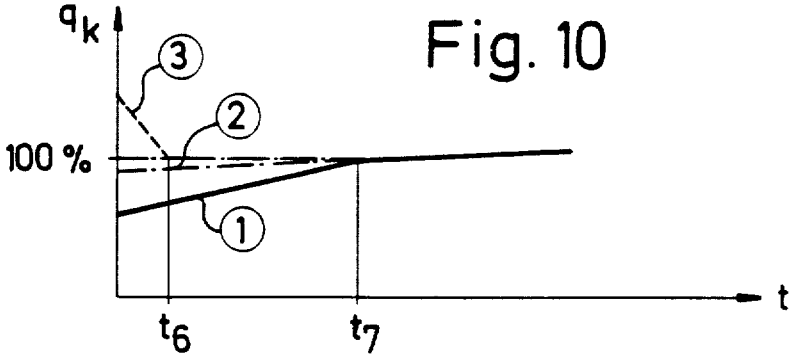
FIG. 10 is a graphical representation showing how the amounts of fuel delivered on resumption as either increments or decrements return to normal delivery as a function of time; and, FIG. 11 is a flow diagram showing the mode of operation of the method of the invention simultaneously with a possible configuration of an apparatus for controlling the overrun mode of operation as an approximate block diagram.

The characteristics of FIG. 10 show that within predetermined periods of time the fuel increments or decrements are regulated back to the normal quantity of 100%; in the case of a decrement, this period of time extends until $t_7$, whereas the increment which is used for a momentary interception of the speed drop is returned to normal in a relatively short period of time lasting until about $t_6$. The dependent relationship of the decremental or incremental control and time as shown in FIG. 10 may also commence not until the throttle-valve switch is opened. Further, in systems suitable for this purpose, that is, systems in which, for example, a Lambda control determines the ratios of the air/fuel mixture supplied to the internal combustion engine, the possibility exists to disable this control during the incremental control functions $q_k=f(-dn/dt;t)$, with defined control quantities being predetermined instead. This prevents a possibly existing mixture control system from counteracting the desired effects.

It is to be understood that the effects, measures and control processes of the invention as described in the foregoing can be implemented applying both digital and analog circuit and signal-processing technology including the use of special computer systems. In this connection, the diagram of FIG. 11 may be construed as a flow diagram for a signal-processing function; such a flow diagram may be used, for example, to represent a program sequence for a computer system, permitting the implementation of the technical effects described by means of external sensors and final controlling elements. The diagram of FIG. 11 may also be construed as a block diagram for the arrangement of discrete components which will be explained in the following with regard to their mode of operation and whose logical relationships will become apparent from the block diagram.

Figure 11:
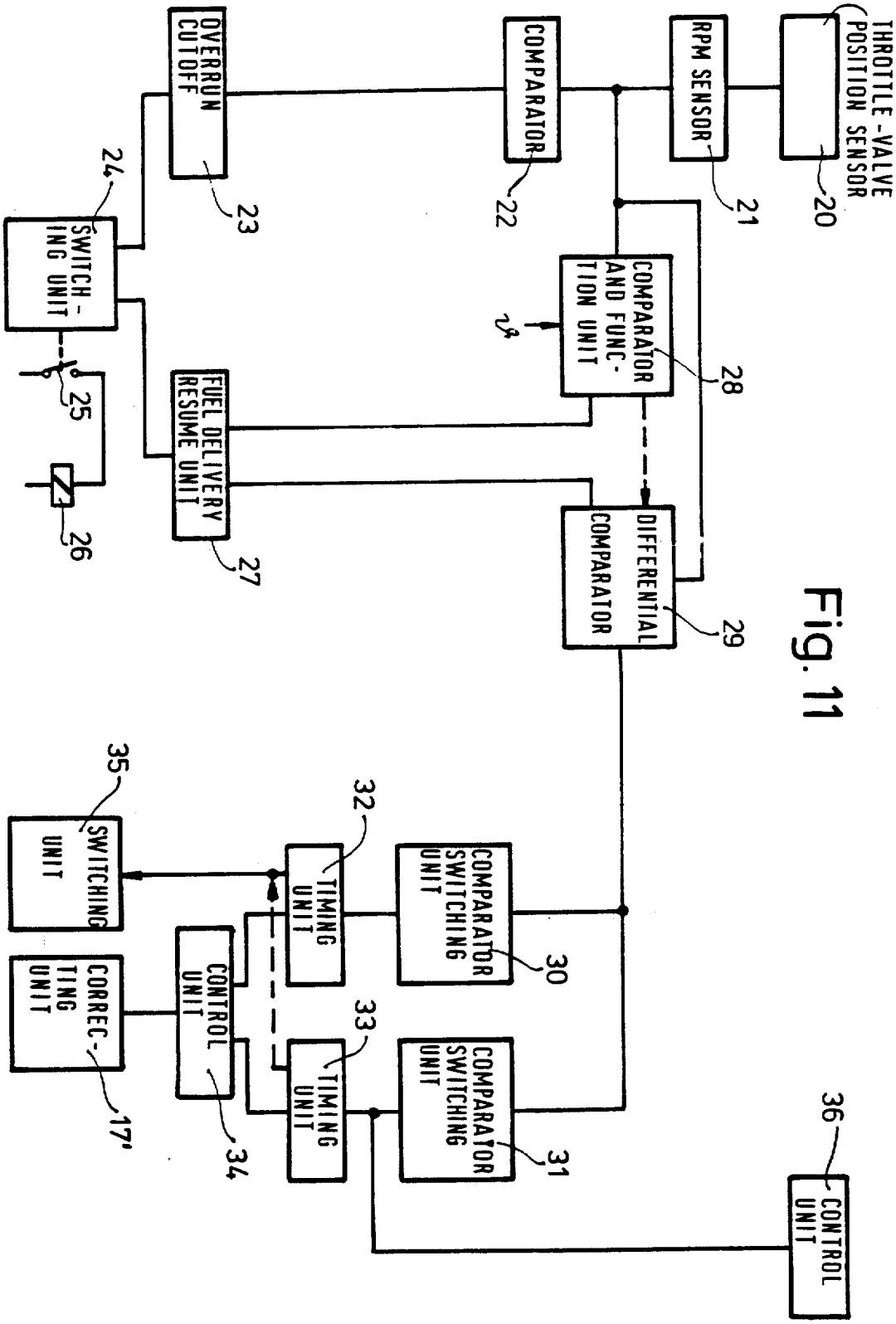

In FIG. 11, reference numeral 20 identifies a throttle-valve position sensor. If the result is positive, the engine speed will be sensed at 21, and block 22 will compare or determine whether the actual speed n is above a fixed threshold speed which may be defined as the static resume threshold $n_1$, for example. If the actual speed exceeds this threshold, that is, $n>n_1$, a cutoff function is performed in overrun cutoff block 23 which in turn activates appropriate areas, switching elements or steps of the fuel-injection system to interrupt the delivery of fuel; in FIG. 11, this is represented symbolically by a switching block 24 which activates a switch 25 series connected with an injection valve 26 and is configured such that a signal issuing from a fuel-delivery resume block 27 will invariably have priority.

A block 28 furnishes the characteristic $n_{RE}$ as a function of time, temperature and negative speed change; in the most general case, the entire characteristic I of FIG. 2 may be influenced; in the most simple case, only a threshold of a resume speed is shifted in dependence on temperature and on the negative speed change $-dn/dt$. At the same time, block 28 compares the actual speed signal n supplied to its input with the relevant characteristic $n_{RE}$ or relevant threshold value and determines whether the actual speed is below or above $n_{RE}$. at any given moment. Resume block 27 is activated immediately when the actual engine speed is found to be below $n_{RE}$ Block 28 may be configured such that a difference formed from the speed signal of block 21 or some other method generates a value indicative of the negative speed characteristic $-dn/dt$ and supplies it as an address to a memory store generating for the individual $-dn/dt$ values stored characteristics for comparison with the actual speed; in an analog processing system, a function generator may be substituted for the memory store, for example.

Complementing or replacing the switching block 28, another differential comparator 29 is provided which generates from the engine speed signal of block 21 or from the negative engine speed differential of block 28 a desired characteristic of the negative speed change as a function of the actual engine speed. Accordingly, block 29 predetermines for specific numerical speed values desired threshold values of a negative speed change, above which the negative instantaneous speed change results in an immediate fuel-delivery resume signal since the engine has to be prevented from stalling. Thus, block 29 compares the negative actual speed change with a characteristic of a desired threshold speed change against the speed, as indicated by characteristic III of FIG. 7, and inhibits the overrun cutoff function via block 27 if the actual value of the negative speed change is above the computed or entered threshold value.

Complementary to this arrangement, two further switching blocks 30, 31 with timing units 32, 33 connected to their outputs are provided to achieve the characteristics of FIGS. 9 and 10. Providing additional information to influence the quantity of fuel in the case of a resumption, blocks 30 and 31 predetermine fixed threshold values of negative speed changes, the lower value being referred to as $-(dn/dt)_1$ and the higher value as $-(dn/dt)_2$ according to FIG. 9. If the actual value of the negative instantaneous speed change is below the lower threshold of block 30, the decision is for a reduced fuel quantity, and the signal goes via timing unit 32 which determines the decay action of the reduced delivery to a control unit 34 influencing the quantity of the fuel-injection pulses; the output signal of block 34 may then be applied to correcting block 17 of FIG. 1 which is identified by 17' in FIG. 11. At the same time, an inhibit instruction relating to a mixture-control system, if any, is issued to a switching block 35 which disables the Lambda control normally providing for control of the mixture composition.

Correspondingly, the decision is for the supply of excess fuel ($t_i$ increment) if the instantaneous value of the negative speed change exceeds the threshold predetermined by switching block 31, that is, if the speed drop is extremely sharp and the engine can only be intercepted safely and particularly smoothly by increasing the amounts of fuel supplied.

The adaptive shutoff system of FIG. 11 is in a position to recognize the need for excess fuel even if a signal indicative of an open throttle valve is received from a block 36 which automatically terminates the overrun cutoff function via blocks 20, 21, 22 and 23. The result is a clean and smooth transition to normal operation.

The arrangement of FIG. 11 emphasizes that the first differential of the rotational speed with time does not serve to recognize overrun operation; instead, this first differential serves to control the internal combustion engine which is in the overrun mode of operation.

It is further understood that the foregoing description is that of the preferred embodiments of the invention and that various changes and modifications may be made thereto without departing from the spirit and scope of the invention as defined in the appended claims.

What is claimed is:

1. Method of controlling the fuel metering apparatus of an internal combustion engine in the overrun mode of operation with a resume speed threshold $n_{RE}(t)$ above which the fuel metered to the engine is interrupted and below which fuel is again metered to the engine, the method comprising:

that the resume speed threshold $n_{RE}(t)$ runs between an upper speed threshold $n_o$ and a lower speed threshold $n_1$; and, in the overrun mode of operation starting said resume speed threshold $n_{RE}(t)$ at a value $n_o$ and reducing said resume speed threshold $n_{RE}(t)$ to a value $n_1$ with the instantaneous value of $n_{RE}(t)$ being dependent upon the first derivative dn/dt of the rotational speed of the engine.

2. The method of claim 1, said threshold $n_o$ and said threshold $n_1$ being dependent upon at least one operating parameter of the engine.

3. The method of claim 2, said operating parameter being the temperature of the engine.

4. The method of claim 2, said operating parameter being the actual rotational speed of the engine.

5. The method of claim 1, said threshold $n_o$ and said threshold $n_1$ being dependent upon the temperature of the engine and the actual rotational speed of the engine.

6. The method of claim 5, wherein only the dynamic resume speed $n_o$ is increased as the negative rotational speed change $-dn/dt$ increases.

7. The method of claim 5, wherein the resume speed is increased as the negative speed change $-dn/dt$ increases, and wherein a first threshold $(-dn/dt)_1$ and a second threshold $(-dn/dt)_2$ are provided, the method comprising the further steps of supplying a decremented quantity of fuel to the engine when the drop in rotational speed of the engine passes below said first threshold $(-dn/dt)_1$ and supplying an incremented quantity of fuel when the drop in rotational speed of the engine passes above said second threshold $(-dn/dt)_2$.

8. The method of claim 7, wherein the engine is equipped with lambda control means for determining the air/fuel ratio, the method comprising the further step of: blocking said control means when changing the amount of fuel supplied from the desired value in dependence upon the negative speed change during the overrun mode of operation.

9. The method of claim 1, wherein there is a lower rotational-speed dependent boundary value for the first derivative (dn/dt) of the actual rotational speed n, the method comprising the further step of resuming the metering of fuel to the engine in the overrun mode of operation when passing beneath said rotational-speed dependent boundary value.

10. Apparatus for controlling the overrun mode of operation of an internal combustion engine in dependence upon the instantaneous rotational speed of the engine and a resume speed threshold characteristic, the apparatus comprising:

throttle-valve sensor means for detecting the position of the throttle-valve;

speed sensor means for detecting the instantaneous value of the rotational speed (n) of the engine;

speed comparator means for determining if the engine speed exceeds the threshold;

overrun cutoff circuit means for determining a fuel cutoff signal or a fuel metering signal; and, comparator and function circuit means for evaluating said negative speed change for comparing resume speed thresholds or for displacing said thresholds, said comparator and function circuit means including circuit means for generating the negative speed change $(-dn/dt)$.

11. The apparatus of claim 10, said comparator and function circuit means further including means for changing individual thresholds or the resume speed time dependent function ($n_{RE}$) in dependence upon the relevant negative speed change $(-dn/dt)$ and, as required, in dependence upon the temperature.

12. The apparatus of claim 10, comprising a differential comparator means for providing a predetermined desired value of a negative speed change curve in dependence upon the relevant instantaneous speed (n); and, said differential comparator means including means for comparing said desired value to the relevant actual value of the negative speed change for producing a fuel delivery resume signal.

13. The apparatus of claim 12, comprising comparator switching means for adjusting the flow of metered fuel after fuel delivery has resumed or by open throttle valve, said comparator switching means comprising comparator means for comparing the actual negative speed change to predetermined fixed threshold values of negative speed change; and, timing means connected to the output of said comparator switching means for imparting a time dependent character to the adjustment of said flow of metered fuel.

14. The apparatus of claim 13, comprising additional switching means for disabling the mixture control means of the engine in response to an output of said timing means.

* * * * *

UNITED STATES PATENT AND TRADEMARK OFFICE

CERTIFICATE OF CORRECTION

PATENT NO. : 4,644,922

DATED : February 24, 1987

INVENTOR(S) : Otto Glockler et al

It is certified that error appears in the above-identified patent and that said Letters Patent is hereby corrected as shown below:

Column 8, line 19, delete the period after "$n_{RE}$".

Column 8, line 22 after "$n_{RE}$" insert a period.

The sheets of drawings containing figures 4-11 should be added as shown on the attached sheets.

Signed and Sealed this

Tenth Day of May, 1988

*Attest:*

DONALD J. QUIGG

*Attesting Officer*

*Commissioner of Patents and Trademarks*

$-\frac{dn}{dt}$
NO OC
III
OC
$n_{mot}$ $n_{RE}$
$-\frac{dn}{dt}$ $q_k$
t = 0
100 %
$-\frac{dn}{dt}$
1
$-(\frac{dn}{dt})_1$
2
$-(\frac{dn}{dt})_2$
3

$q_k$
3
2
100 %
1
t
$t_6$
$t_7$